US012117281B2

(12) United States Patent
Kuk

(10) Patent No.: US 12,117,281 B2
(45) Date of Patent: Oct. 15, 2024

(54) BLASTING DEVICE FOR SIMULTANEOUSLY REGISTERING MULTIPLE DETONATORS BASED ON BLASTING PATTERN INFORMATION AND METHOD OF USING THE SAME

(71) Applicant: HANWHA CORPORATION, Seoul (KR)

(72) Inventor: Yong Seok Kuk, Chungcheongbuk-do (KR)

(73) Assignee: HANWHA CORPORATION, Seoul (KR)

( * ) Notice: Subject to any disclaimer, the term of this patent is extended or adjusted under 35 U.S.C. 154(b) by 0 days.

(21) Appl. No.: 17/623,466

(22) PCT Filed: Dec. 21, 2021

(86) PCT No.: PCT/KR2021/019486

§ 371 (c)(1),
(2) Date: Dec. 28, 2021

(87) PCT Pub. No.: WO2023/120758

PCT Pub. Date: Jun. 29, 2023

(65) Prior Publication Data

US 2024/0044629 A1 Feb. 8, 2024

(51) Int. Cl.

| | |
|---|---|
| ***F42D 1/055*** | (2006.01) |
| ***E04G 23/08*** | (2006.01) |
| ***F42D 3/04*** | (2006.01) |

(52) U.S. Cl.

CPC ..... *F42D 1/055* (2013.01); *E04G 23/08* (2013.01); *F42D 3/04* (2013.01)

(58) Field of Classification Search

CPC ..... F42D 1/055

(Continued)

(56) References Cited

U.S. PATENT DOCUMENTS 7,791,858 B2 * 9/2010 Hummel ..... F42D 1/05 361/247

2005/0103219 A1 5/2005 McClure et al.

(Continued)

FOREIGN PATENT DOCUMENTS

KR 10-2129303 B1 7/2020
KR 10-2129305 B1 7/2020

(Continued)

*Primary Examiner* — Reginald S Tillman, Jr.
(74) *Attorney, Agent, or Firm* — WHDA, LLP

(57) ABSTRACT

The present disclosure relates to a blasting device for simultaneously registering multiple detonators based on blasting pattern information and a method of using the same, and the blasting device includes a blasting pattern information input unit that receives blasting pattern information about a blasting operation to be performed to store the received blasting pattern information, a key value sharing unit that shares a key value with a tracker possessed by an operator when the tracker is activated, a blasting area entry recognition unit that recognizes at least one communication module and tracker that are activated in a blasting area, and a detonator registration unit that registers multiple detonators by using the number of the at least one communication module and tracker recognized in the blasting area and pre-stored blasting pattern information.

13 Claims, 8 Drawing Sheets

(58) Field of Classification Search
USPC ..... 102/311, 312
See application file for complete search history.

(56) References Cited

U.S. PATENT DOCUMENTS

| | | | | |
|---|---|---|---|---|
| 2014/0026775 | A1 | 1/2014 | Papillon | |
| 2023/0057631 | A1* | 2/2023 | Muller | F42D 1/055 |

FOREIGN PATENT DOCUMENTS

| | | | |
|---|---|---|---|
| KR | 10-2129306 | B1 | 7/2020 |
| WO | 2015/034882 | A1 | 3/2015 |

* cited by examiner

BLASTING DEVICE FOR SIMULTANEOUSLY REGISTERING MULTIPLE DETONATORS BASED ON BLASTING PATTERN INFORMATION AND METHOD OF USING THE SAME

TECHNICAL FIELD

One aspect of the present disclosure relates to a blasting device for simultaneously registering multiple detonators based on blasting pattern information and a method of using the same, and more particularly, to a blasting device for simultaneously registering multiple detonators based on blasting pattern information which simultaneously registers multiple detonators by using the number of at least one communication module and tracker recognized in a blasting area and pre-stored blasting pattern information, and a method of using the same.

BACKGROUND ART

In general, explosives are used for construction such as blasting of bedrock, blasting of abandoned buildings and the like. That is, by dividing a blasting object by section, a plurality of holes into which explosives are inserted are drilled. An explosive is inserted into each of the drilled holes, and then is connected to a blasting system. By detonating the explosives through the operation of the blasting system, the blasting object is detonated.

The blasting system includes a detonator that detonates an explosive, and a blasting device that transmits, to the detonator, power and commands necessary for the operation of the detonator. In this case, as the detonator of the blasting system, an electronic detonator is mainly used. The electronic detonator is installed on the explosive side, and a plurality of electronic detonators are connected to one blasting device.

The electronic detonator has two types of structures: one structure in which, when a command is transmitted from the blasting device, a plurality of electronic detonators connected to the blasting device operate simultaneously to detonate explosives at the same time, and the other structure in which a plurality of electronic detonators are set with different delay times, and the plurality of electronic detonators operate sequentially to detonate explosives sequentially.

Conventionally, the electronic detonator for simultaneously detonating multiple explosives has been mainly used, but in these days, the electronic detonator for sequentially detonating multiple explosives is mainly used. Examples of many documents disclosing a blasting system using an electronic detonator include Korean Patent No. 10-1016538, Korean Patent No. 10-0665878. Korean Patent No. 10-0665880, Korean Patent No. 10-0733346, and Japanese Unexamined Patent Application Publication No. 2005-520115.

DISCLOSURE

Technical Problem

The present disclosure has been made in order to solve the above-mentioned problems, and an object of the present disclosure is to provide a blasting device for simultaneously registering multiple detonators based on blasting pattern information sharing a key value with a tracker possessed by an operator when the tracker is activated, and a method of using the same.

In addition, another object of the present disclosure is to provide a blasting device for simultaneously registering multiple detonators based on blasting pattern information which registers multiple detonators by using the number of at least one communication module and tracker recognized in a blasting area and pre-stored blasting pattern information, and a method of using the same.

Technical Solution

In order to achieve the above-mentioned objects, there is provided a blasting device for simultaneously registering multiple detonators based on blasting pattern information including: a blasting pattern information input unit that receives blasting pattern information about a blasting operation to be performed to store the received blasting pattern information; a key value sharing unit that shares a key value with a tracker possessed by an operator when the tracker is activated; a blasting area entry recognition unit that recognizes at least one communication module and tracker that are activated in a blasting area; and a detonator registration unit that registers multiple detonators by using the number of the at least one communication module and tracker recognized in the blasting area and pre-stored blasting pattern information.

The key value sharing unit may share a key value for determining a blasting device in which each tracker is to be registered, when the tracker is to be registered with multiple blasting devices.

Further, the detonator registration unit includes: a first registration unit that, when one tracker and one communication module are recognized in the blasting area, registers the communication module in the blasting device registered through the key value that the tracker has, and registers a detonator corresponding to a blasting hole located at a minimum distance from a position of the tracker by comparing position pattern values included position information about the tracker and the blasting pattern information stored in the blasting device; and a second registration unit that, when one tracker and two or more communication modules are recognized in the blasting area, registers, in order, communication modules activated according to a deck charge number included in the blasting pattern information stored in the blasting device in the blasting device registered through the key value that the tracker has, and registers a detonator corresponding to a blasting hole located at a minimum distance from a position of the tracker by comparing position pattern values included in position information about the tracker and the blasting pattern information stored in the blasting device.

Further, the detonator registration unit may include: a third registration unit that, when two or more trackers and one communication module are recognized in the blasting area, pairs the communication module with a tracker located at a minimum distance from the communication module, the minimum distance being obtained by each tracker measuring a distance from the communication module using a received round trip time (RTT) and then registers the communication module in the blasting device registered through the key value that the tracker has, and registers a detonator corresponding to a blasting hole located at a minimum distance from a position of the tracker by comparing position pattern values included in position information about the tracker and the blasting pattern information stored in the blasting device; and a fourth registration unit that, when two or more trackers and two or more communication modules are recognized in the blasting area, pairs a communication module and a tracker that are located at a minimum distance between each other, the minimum distance being obtained by each communication module and each tracker measuring a distance between each other using received round trip times (RTTs) and then registers the communication module in the blasting device registered through the key value that the tracker has, and registers a detonator corresponding to a blasting hole located at a minimum distance from a position of the tracker by comparing position pattern values included in position information about the tracker and the blasting pattern information stored in the blasting device.

Further, the blasting device may further include a detonator position output unit that, when a registered detonator is activated, outputs a coordinate map according to a blasting blueprint for the registered detonator and a coordinate map according to global positioning system (GPS) information for a current detonator to a display.

Further, the blasting device may further include a detonator information check unit that outputs information about the registered detonator to a display by receiving the information about the registered detonator through the communication module when data loading is completed after the registered detonator is activated, to check and correct the information about the detonator through the display.

Further, the blasting device may further include an arming command transmission unit that transmits an arming command when data loading is completed after the registered detonator is activated and check of information about the detonator is completed.

Further, the tracker may receive a position correction value from a real time kinematic (RTK) positioning information system at preset time intervals, when the tracker is activated.

Further, the communication module may switch to a sleep mode after providing information about the registered detonator to the blasting device.

In order to achieve the above-mentioned objects, there is provided a method of using a blasting device including: receiving, by a blasting pattern information input unit, blasting pattern information about a blasting operation to be performed to store the received blasting pattern information; sharing, by a key value sharing unit, a key value with a tracker possessed by an operator when the tracker is activated; recognizing, by a blasting area entry recognition unit, at least one communication module and tracker that are activated in a blasting area; and registering, by a detonator registration unit, multiple detonators by using the number of the at least one communication module and tracker recognized in the blasting area and pre-stored blasting pattern information.

Further, the registering of the multiple detonators by using the number of the at least one communication module and tracker recognized in the blasting area and pre-stored blasting pattern information may include: when one tracker and one communication module are recognized in the blasting area, registering the communication module in the blasting device registered through the key value that the tracker has, and registering a detonator corresponding to a blasting hole located at a minimum distance from a position of the tracker by comparing position pattern values included in position information about the tracker and the blasting pattern information stored in the blasting device.

Further, the registering of the multiple detonators by using the number of the at least one communication module and tracker recognized in the blasting area and the pre-stored blasting pattern information may include: when one tracker and two or more communication modules are recognized in the blasting area, registering, in order, communication modules activated according to a deck charge number included in the blasting pattern information stored in the blasting device in the blasting device registered through the key value that the tracker has, and registering a detonator corresponding to a blasting hole located at a minimum distance from a position of the tracker by comparing position pattern values included in position information about the tracker and the blasting pattern information stored in the blasting device.

Further, the registering of the multiple detonators by using the number of the at least one communication module and tracker recognized in the blasting area and the pre-stored blasting pattern information may include: when two or more trackers and one communication module are recognized in the blasting area, paring the communication module and a tracker located at a minimum distance from the communication module, the minimum distance being obtained by each tracker measuring a distance from the communication module using a received round trip time (RTT) and then registering the communication module in the blasting device registered through the key value that the tracker has, and registering a detonator corresponding to a blasting hole located at a minimum distance from a position of the tracker by comparing position pattern values included in position information about the tracker and the blasting pattern information stored in the blasting device.

Further, the registering of the multiple detonators by using the number of the at least one communication module and tracker recognized in the blasting area and the pre-stored blasting pattern information may include: when two or more trackers and two or more communication modules are recognized in the blasting area, paring a communication module and a tracker that are located at a minimum distance from each other, the minimum distance being obtained by each communication module and each tracker measuring a distance between each other using received round trip times (RTs) and then registering the communication module in the blasting device registered through the key value that the tracker has, and registering a detonator corresponding to a blasting hole located at a minimum distance from a position of the tracker by comparing position pattern values included in position information about the tracker and the blasting pattern information stored in the blasting device.

Further, the method may further include: after the registering of the multiple detonators by using the number of the at least one communication module and tracker recognized in the blasting area and the pre-stored blasting pattern information, outputting, when a registered detonator is activated, a coordinate map according to a blasting blueprint for the registered detonator and a coordinate map according to global positioning system (GPS) information a current detonator to a display.

Further, the method may include: after the registering of the multiple detonators by using the number of the at least one communication module and tracker recognized in the blasting area and the pre-stored blasting pattern information, outputting information about the registered detonator to a display by receiving the information about the registered detonator through the communication module when data loading is completed after the registered detonator is activated, to check and correct the information about the detonator through the display.

Further, the method may include: after the registering of the multiple detonators by using the number of the at least one communication module and tracker recognized in the blasting area and the pre-stored blasting pattern information, transmitting an arming command when data loading is completed after the registered detonator is activated and check of information about the detonator is completed.

Advantageous Effects

A blasting device for simultaneously registering multiple detonators based on blasting pattern information according to the present disclosure for achieving the above objects and a method of using the same have the effect of preventing collisions in case of multiple blasting by allowing a key value to be shared with a tracker possessed by an operator when the tracker is activated, thereby allowing the blasting device in which each tracker to be registered to be easily determined when the tracker is to be registered with multiple blasting devices.

In addition, the present disclosure has the effect of maximizing work efficiency by allowing multiple operators to simultaneously perform detonator registration by registering multiple detonators using the number of at least one communication module and tracker recognized in the blasting area (a case of one tracker and one communication module, a case of one tracker and two or more communication modules, a case of two or more trackers and one communication module, and a case of two or more trackers and two or more communication modules) and pre-stored blasting pattern information. As a result, the present disclosure has the effect of minimizing human errors and improving stability.

DESCRIPTION OF REFERENCE NUMERALS

Figure 1:
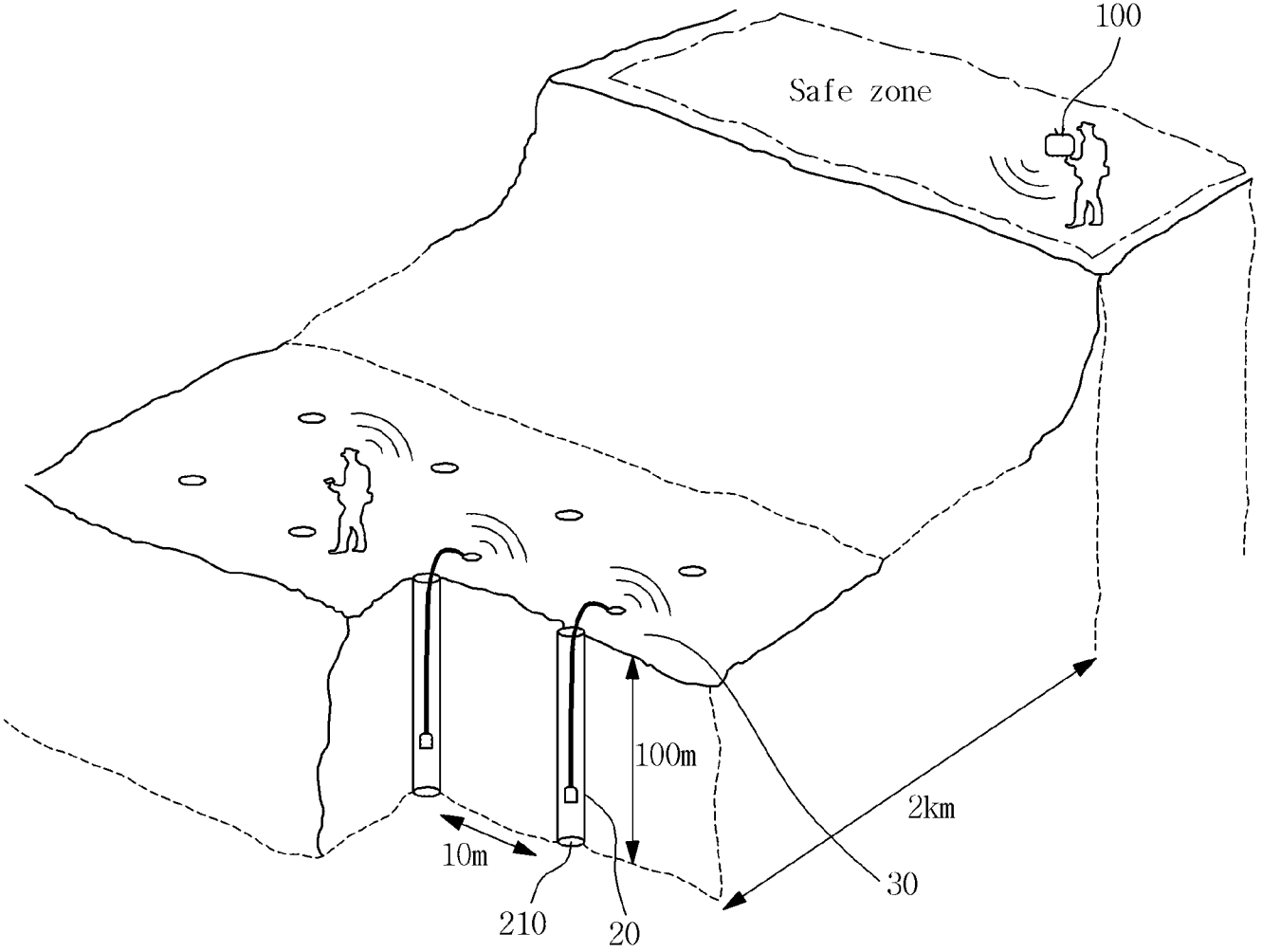
FIG. 1 is a view for describing a system to which a blasting device for simultaneously registering multiple detonators based on blasting pattern information according to the present disclosure is applied.

100: Blasting device for simultaneously registering multiple detonators based on blasting pattern information
110: Blasting pattern information input unit
120: Key value sharing unit
130: Blasting area entry recognition unit
140: Detonator registration unit
150: Detonator position output unit
160: Detonator information check unit
170: Arming command transmission unit

BEST MODE

It is to be understood that the present disclosure may be variously modified and embodied, and thus particular embodiments thereof will be illustrated in the drawings and described in detail.

However, this is not intended to limit the present disclosure to the specific embodiments, it should be understood to include all modifications, equivalents, and substitutes included in the spirit and scope of the present disclosure. In describing each drawing, like reference numerals have been used for like elements.

It will be understood that when an element is referred to as being "coupled" or "connected" to another element, the element may be directly coupled or connected to the other element, or intervening elements may also be present. In contrast, it will be understood that when an element is referred to as being "directly coupled" or "directly connected" to another element, there are not intervening elements present.

The terms used in the present application are merely provided to describe specific embodiments, and are not intended to limit the present disclosure. The singular forms, "a", "an" and "the" are intended to include the plural forms as well, unless the context clearly indicates otherwise. In the present application, it will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Hereinafter, preferred embodiments of the present disclosure will be described in more detail with reference to the accompanying drawings. Hereinafter, the same reference numerals are used for the same elements in the drawings, and duplicate descriptions for the same elements are omitted.

FIG. 1 is a view for describing a system to which a blasting device for simultaneously registering multiple detonators based on blasting pattern information according to the present disclosure is applied.

Referring to FIG. 1, the system according to the present disclosure largely includes multiple detonators 10, trackers 20, communication modules 30, and a blasting device 100 for simultaneously registering multiple detonators based on blasting pattern information.

When the tracker 20 is activated, the tracker 20 receives a position correction value from a real time kinematic (RTK) positioning information system at preset time intervals.

The communication module 30 switches to a sleep mode after providing the information about the registered detonators to the blasting device. Meanwhile, a detonator state (for example, battery level, absolute time, signal strength, delay time, hole numbers, or the like) may be checked from time to time on a display of the blasting device 100 in which one or more detonators are detected/registered.

The blasting device 100 for simultaneously registering multiple detonators based on blasting pattern information according to the present disclosure simultaneously registers multiple detonators 10 by using the number of at least one communication module 30 and tracker 20 recognized in the blasting area and pre-stored blasting pattern information.

Figure 2:
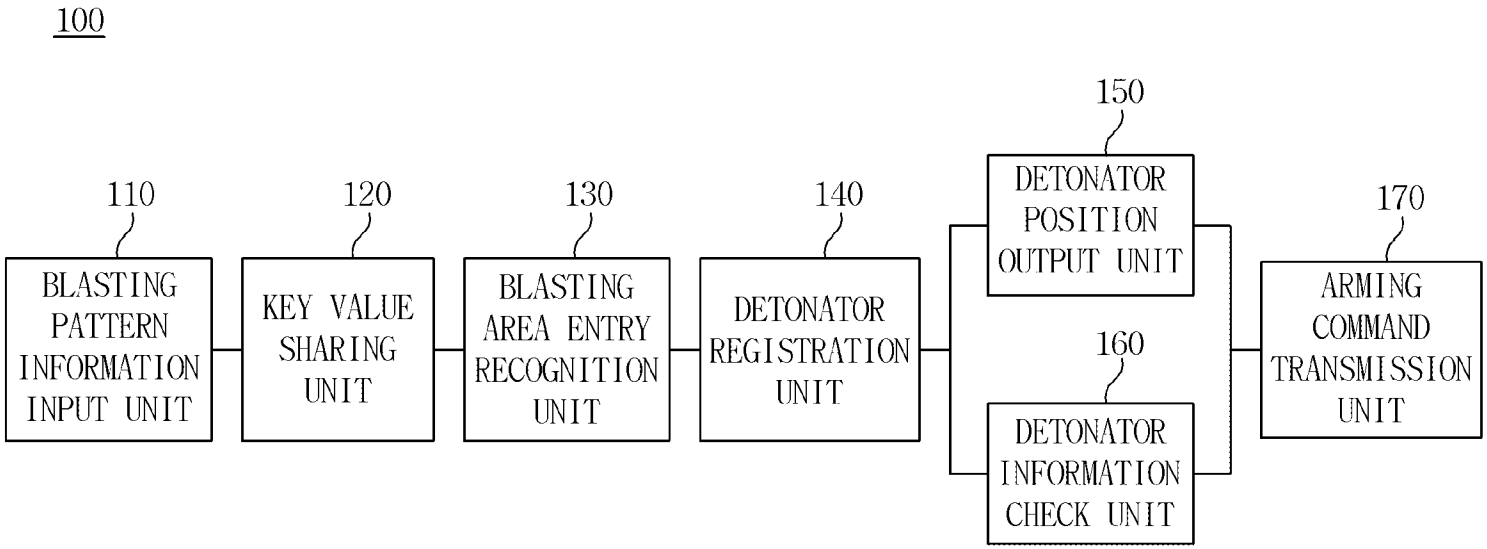
FIG. 2 is a view for describing a configuration of the blasting device for simultaneously registering multiple detonators based on blasting pattern information according to the present disclosure.

FIG. 2 is a view for describing a configuration of the blasting device for simultaneously registering multiple detonators based on blasting pattern information according to the present disclosure.

Referring to FIG. 2, the blasting device 100 for simultaneously registering multiple detonators based on blasting pattern information according to the present disclosure includes a blasting pattern information input unit 110, a key value sharing unit 120, a blasting area entry recognition unit 130, a detonator registration unit 140, a detonator position output unit 150, a detonator information check unit 160, and an arming command transmission unit 170.

The blasting pattern information input unit 110 receives and stores blasting pattern information about a blasting operation to be performed.

The blasting pattern information input unit 110 secures the blasting pattern information by hardware copy before the blasting operation starts or downloads it from blasting software through a USB terminal. Here, when the pattern and location information downloaded from a blasting design program cannot be used, it is assumed that one operator turns on the communication modules one by one.

The key value sharing unit 120 shares a key value with a tracker possessed by an operator when the tracker is activated. Here, the operator checks whether the tracker is operating normally before entering the site.

The key value sharing unit 120 shares a key value for determining a blasting device in which each tracker is to be registered, when the tracker is to be registered with multiple blasting devices.

The blasting area entry recognition unit 130 recognizes at least one communication module and tracker that are activated in the blasting area. That is, the blasting area entry recognition unit 130 recognizes a situation in which multiple operators enter the blasting site with the tracker and activate the communication modules. In this case, the tracker may receive a position correction value from a real time kinematic (RTK) positioning information system at preset time intervals to accurately measure the positions of the multiple operators.

The detonator registration unit 140 registers multiple detonators by using the number of the at least one communication module and tracker recognized in the blasting area and pre-stored blasting pattern information. In this case, the multiple detonators are positioned around respective corresponding blasting holes before the operators enter the blasting site.

The detonator registration unit 140 registers multiple detonators by using the number of at least one communication module and tracker recognized in the blasting area (for example, a case of one tracker and one communication module, a case of one tracker and two or more communication modules, a case of two or more trackers and one communication module, and a case of two or more trackers and two or more communication modules) and pre-stored blasting pattern information. The configuration and function of the above will be described in detail with reference to FIG. 3 to be described later.

Meanwhile, the detonator may notify the operator of registration by LED lighting or a buzzer.

When a registered detonator is activated, the detonator position output unit 150 outputs, to a display, a coordinate map according to a blasting blueprint for the registered detonator and a coordinate map according to global positioning system (GPS) information for a current detonator.

In more detail, the detonator position output unit 150 displays, on the display, the coordinate map according to the blasting blueprint and the coordinate map according to the GPS information, and the user may check whether the design coordinates and the current coordinates match by pressing a screen switch (marked in green/red per hole).

The detonator information check unit 160 may output information about the registered detonator to a display by receiving the information about the registered detonator through the communication module, when data loading is completed after the registered detonator is activated, to enable the user to check and correct the information about the detonator through the display.

Here, the operator possessing the tracker lowers the detonator down through the blasting hole and starts data charging, and when the data charging is finished, the operator puts the detonator down stably next to the blasting hole, moves to the next blasting hole, and repeats the detonator registration process. After the detonator registration process is completed, when it is determined that there is no abnormality in the information about the detonators, the operator possessing the tracker is moved to a safe area.

The arming command transmission unit 170 transmits an arming command when data loading is completed after the registered detonator is activated and check of the information about the detonator is completed through the tracker.

The arming command transmission unit 170 allows the arming command to be performed using a security key when there is no abnormality in the information about the detonators.

Figure 3:
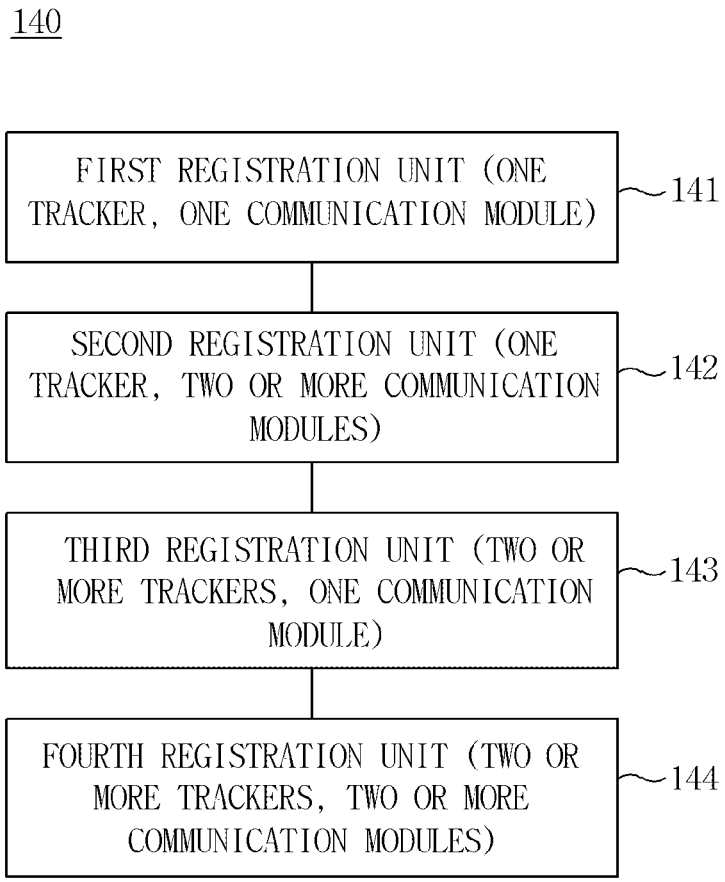
FIG. 3 is a view for describing a detailed configuration of a detonator registration unit employed in the blasting device for simultaneously registering multiple detonators based on blasting pattern information according to the present disclosure.

FIG. 3 is a view for describing a detailed configuration of the detonator registration unit employed in the blasting device for simultaneously registering multiple detonators based on blasting pattern information according to the present disclosure.

Referring to FIG. 3, the detonator registration unit 140 according to the present disclosure registers multiple detonators by using the number of at least one communication module and tracker recognized in the blasting area and pre-stored blasting pattern information.

To this end, the detonator registration unit 140 includes a first registration unit 141, a second registration unit 142, a third registration unit 143, and a fourth registration unit 144.

When one tracker and one communication module are recognized in the blasting area, the first registration unit 141 registers the communication module in the blasting device registered through the key value that the tracker has, and registers a detonator corresponding to a blasting hole located at a minimum distance from a position of the tracker by comparing position pattern values included in position information about the tracker and the blasting pattern information stored in the blasting device.

When one tracker and two or more communication modules are recognized in the blasting area, the second registration unit 142 registers, in order, communication modules activated according to a deck charge number included in the blasting pattern information stored in the blasting device in the blasting device registered through the key value that the tracker has, and registers a detonator corresponding to a blasting hole located at a minimum distance from a position of the tracker by comparing position pattern values included in position information about the tracker and the blasting pattern information stored in the blasting device.

When two or more trackers and one communication module are recognized in the blasting area, the third registration unit 143 pairs the communication module with a tracker located at a minimum distance from the communication module, the minimum distance being obtained by each tracker measuring a distance from the communication module using a received round trip time (RT) and then registers the communication module in the blasting device registered through the key value that the tracker has, and registers a detonator corresponding to a blasting hole located at a minimum distance from a position of the tracker by comparing position pattern values included in position information about the tracker and the blasting pattern information stored in the blasting device.

When two or more trackers and two or more communication modules are recognized in the blasting area, the fourth registration unit 144 pairs a communication module and a tracker that are located at a minimum distance between each other, the minimum distance being obtained by each communication module and each tracker measuring a distance between each other using received round trip times (RTTs) and then registers the communication module in the blasting device registered through the key value that the tracker has, and registers a detonator corresponding to a blasting hole located at a minimum distance from a position of the tracker by comparing position pattern values included in position information about the tracker and the blasting pattern information stored in the blasting device.

Figure 4:
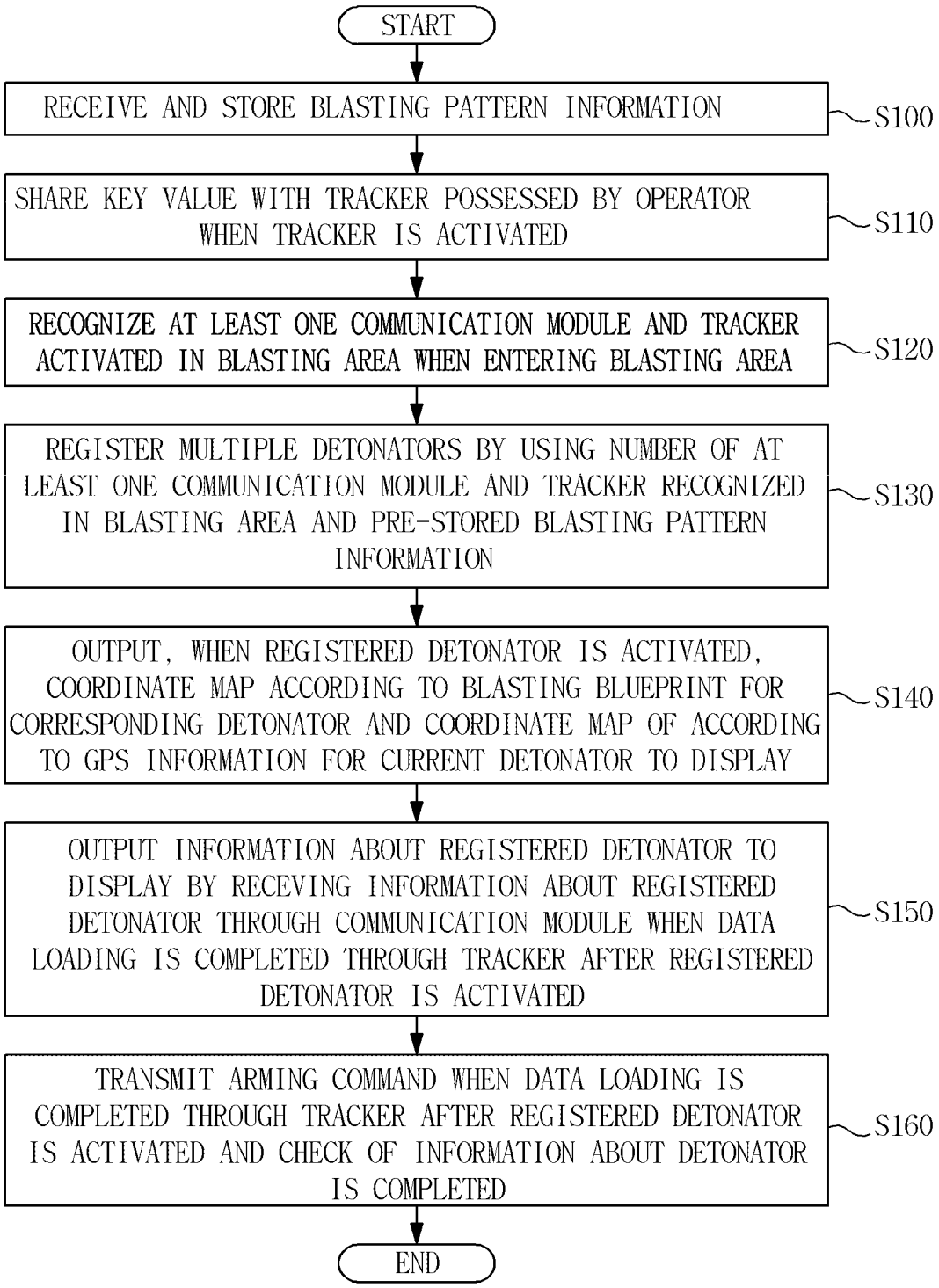
FIG. 4 is a flowchart showing a method of using the blasting device for simultaneously registering multiple detonators based on blasting pattern information according to the present disclosure.

FIG. 4 is a flowchart showing a method of using the blasting device for simultaneously registering multiple detonators based on blasting pattern information according to the present disclosure.

Referring to FIG. 4, the method of using the blasting device for simultaneously registering multiple detonators based on blasting pattern information according to the present disclosure uses the above-described blasting device for simultaneously registering multiple detonators based on blasting pattern information, and therefore, the description thereof will not be repeated.

First, blasting pattern information about a blasting operation to be performed is received and stored (S100).

In step S100, the blasting pattern information is secured by hardware copy or downloaded from blasting software through a USB terminal before the blasting operation starts.

Next, a key value is shared with a tracker possessed by an operator when the tracker is activated (S110).

Then, at least one communication module and tracker that are activated in a blasting area are recognized (S120).

In step S120, a case is recognized where multiple operators have entered the blasting site with the trackers and activated the communication module, and positions of the multiple operators may be accurately measured through the trackers receiving a position correction value from a real time kinematic (RTK) positioning information system at preset time intervals.

Then, the multiple detonators are registered by using the number of the at least one communication module and tracker recognized in the blasting area and the pre-stored blasting pattern information (S130).

In step S130, the multiple detonators are registered by using the number of at least one communication module and tracker recognized in the blasting area (for example, a case of one tracker and one communication module, a case of one tracker and two or more communication modules, a case of two or more trackers and one communication module, and a case of two or more trackers and two or more communication modules) and pre-stored blasting pattern information.

Then, when a registered detonator is activated, a coordinate map according to a blasting blueprint for the corresponding detonator and a coordinate map according to global positioning system (GPS) information for current detonator are output to the display (S140).

Then, information about the detonator is output to a display by receiving the information about the registered detonator through the communication module when data loading is completed through the tracker after the registered detonator is activated, to enable the user to check and correct the information about the detonator through the display (S150).

Then, an arming command is transmitted when data loading is completed through the tracker after the registered detonator is activated and check of the information about the detonator is completed (S160).

In step S160, the arming command may be performed using a security key when there is no abnormality in the information about the detonators.

Figure 5:
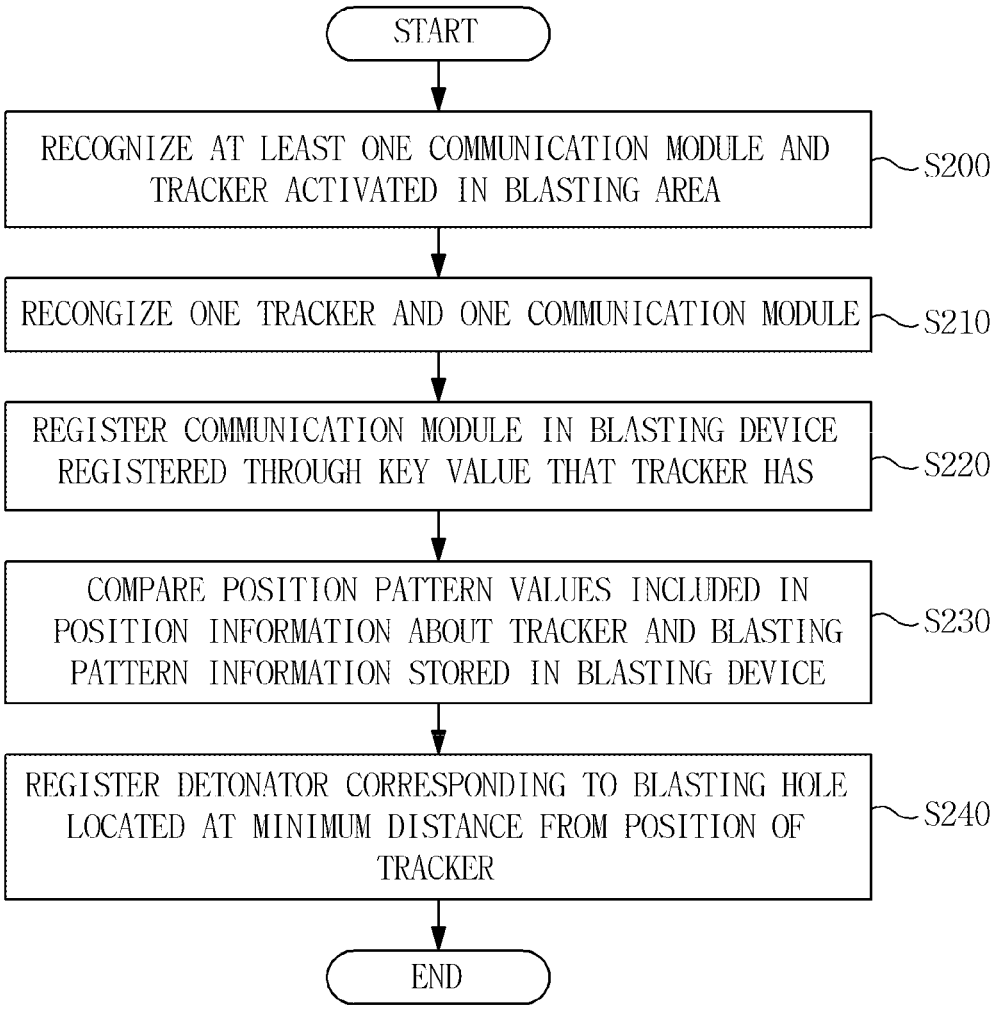
FIG. 5 is a flowchart showing a method of registering detonators when one tracker and one communication module are recognized in a blasting area in the method of using the blasting device for simultaneously registering multiple detonators based on blasting pattern information according to the present disclosure.

FIG. 5 is a flowchart showing a method of registering detonators when one tracker and one communication module are recognized in the blasting area in the method of using the blasting device for simultaneously registering multiple detonators based on blasting pattern information according to the present disclosure.

Referring to FIG. 5, in the method of registering detonators when one trackers and one communication module are recognized in the blasting area according to the present disclosure, first, at least one communication module and tracker activated in the blasting area are recognized (S200).

Next, when one tracker and one communication module are recognized (S210), the communication module is registered in the blasting device registered through the key value that the tracker has (S220).

Then, the position pattern values included in the position information about the tracker and the blasting pattern information stored in the blasting device are compared (S230).

Then, as a result of comparison, a detonator corresponding to a blasting hole located at a minimum distance from the position of the tracker is registered (S240).

Figure 6:
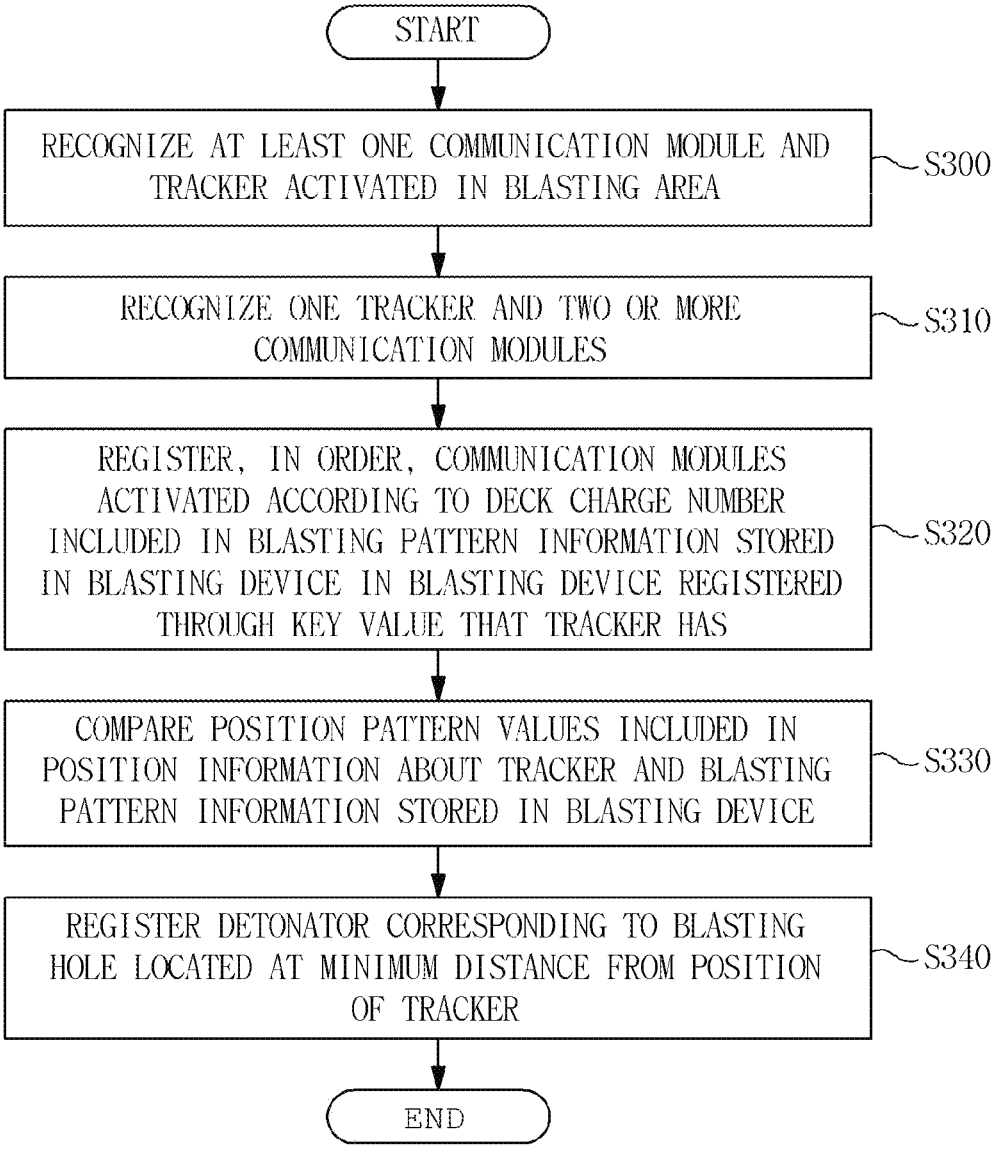
FIG. 6 is a flowchart showing a method of registering detonators when one tracker and two or more communication modules are recognized in the blasting area in the method of using the blasting device for simultaneously registering multiple detonators based on blasting pattern information according to the present disclosure.

FIG. 6 is a flowchart showing a method of registering detonators when one tracker and two or more communication modules are recognized in the blasting area in the method of using the blasting device for simultaneously registering multiple detonators based on blasting pattern information according to the present disclosure.

Referring to FIG. 6, in the method of registering detonators when one tracker and two or more communication modules are recognized in the blasting area according to the present disclosure, first, at least one communication module and tracker activated in the blasting area are recognized (S300).

Next, when one tracker and two or more communication modules are recognized (S310), communication modules activated according to a deck charge number included in the blasting pattern information stored in the blasting device are registered in order in the blasting device registered through the key value that the tracker has (S320).

Then, the position pattern values included in the position information about the tracker and the blasting pattern information stored in the blasting device are compared (S330).

Then, as a result of comparison, a detonator corresponding to a blasting hole located at a minimum distance from the position of the tracker is registered (S340).

Figure 7:
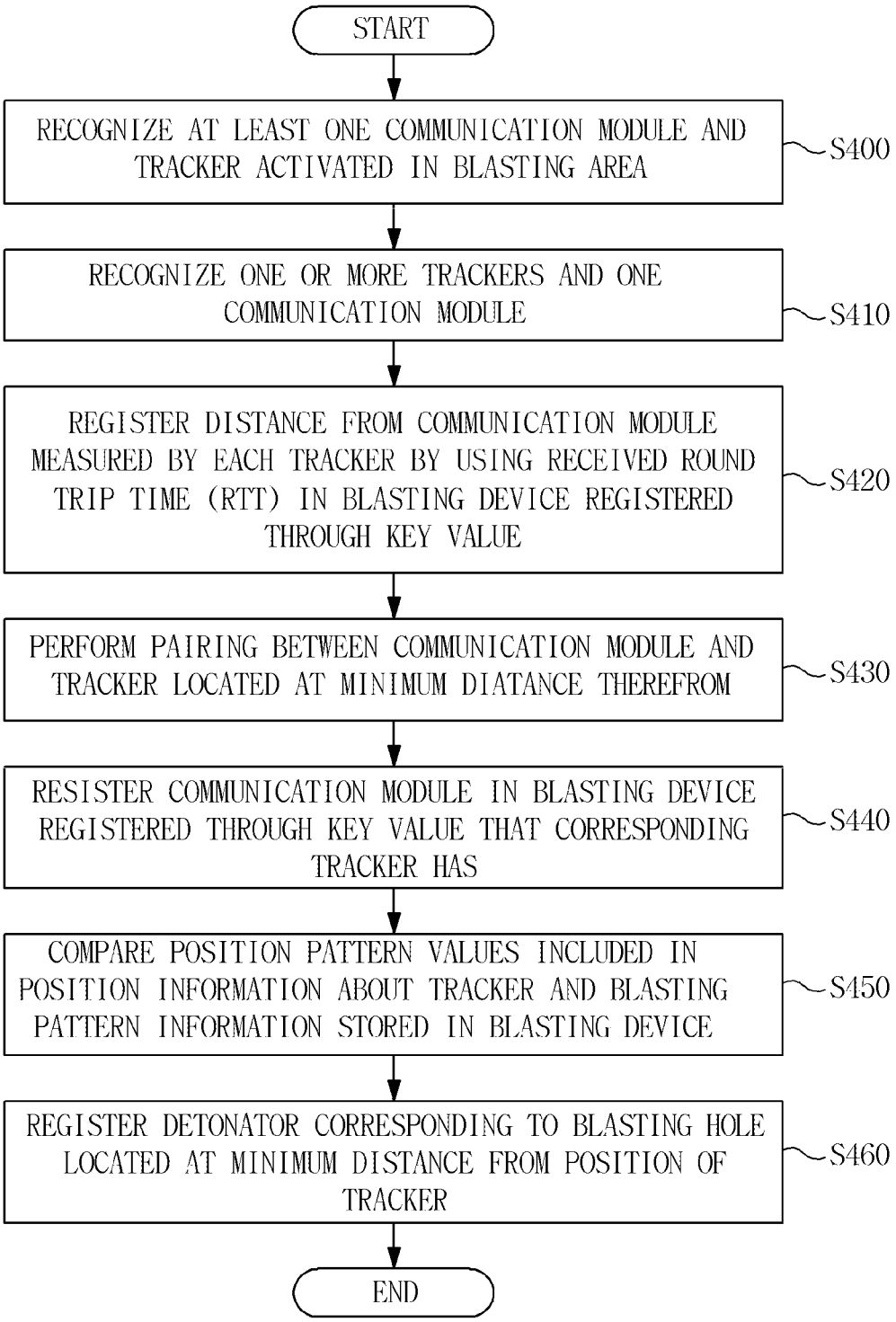
FIG. 7 is a flowchart showing a method of registering detonators when two or more trackers and one communication module are recognized in the blasting area in the method of using the blasting device for simultaneously registering multiple detonators based on blasting pattern information according to the present disclosure.

FIG. 7 is a flowchart showing a method of registering detonators when two or more trackers and one communication module are recognized in the blasting area in the method of using the blasting device for simultaneously registering multiple detonators based on blasting pattern information according to the present disclosure.

Referring to FIG. 7, in the method of registering detonators when two or more trackers and one communication module are recognized in the blasting area according to the present disclosure, first, at least one communication module and tracker activated in the blasting area are recognized (S400).

Next, when two or more trackers and one communication module are recognized (S410), each tracker measures the distance from the communication module by using a received round trip time (RTT) (S420).

Then, pairing is performed between the communication module and the tracker located at the minimum distance therefrom (S430).

Then, the communication module is registered in the blasting device registered through the key value the corresponding tracker has (S440).

Then, the position pattern values included in the position information about the tracker and the blasting pattern information stored in the blasting device are compared (S450).

Then, as a result of comparison, a detonator corresponding to a blasting hole located at a minimum distance from the position of the tracker is registered (S460).

Figure 8:
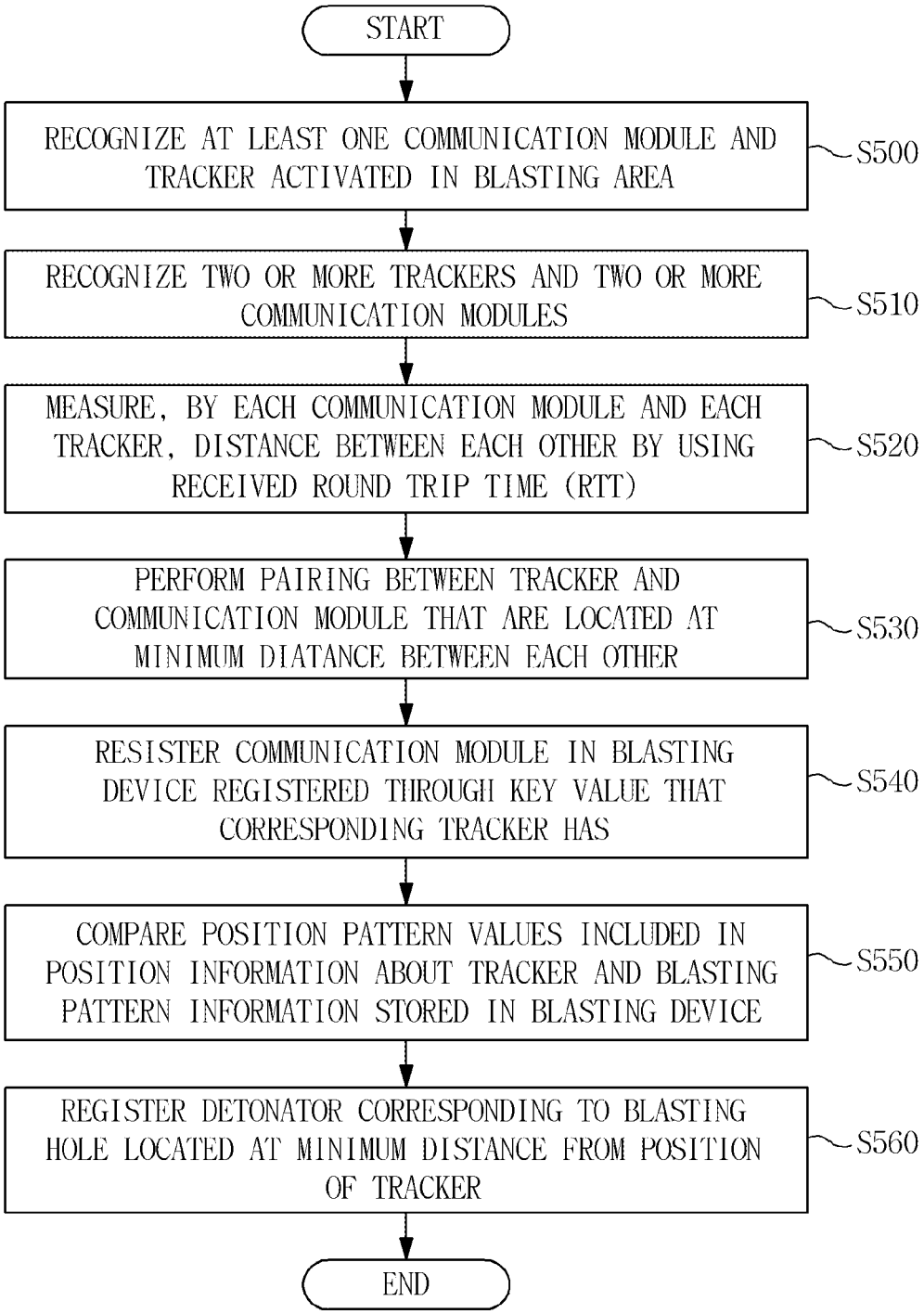
FIG. 8 is a flowchart showing a method of registering detonators when there are two or more trackers and two or more communication modules in the blasting area in the method of using the blasting device for simultaneously registering multiple detonators based on blasting pattern information according to the present disclosure.

FIG. 8 is a flowchart showing a method of registering detonators when there are two or more trackers and two or more communication modules in the blasting area in the method of using the blasting device for simultaneously registering multiple detonators based on blasting pattern information according to the present disclosure.

Referring to FIG. 8, in the method of registering detonators when there are two or more trackers and two or more communication modules in the blasting area according to the present disclosure, first, at least one communication module and tracker activated in the blasting area are recognized (S500).

Next, when two or more trackers and two or more communication modules are recognized (S510), each communication module and each tracker measure the distance between each other by using a received round trip time (RTT) (S520).

Then, pairing is performed between the tracker and the communication module located at the minimum distance between each other (S530).

Then, the communication module is registered in the blasting device registered through the key value the corresponding tracker has (S540).

Then, the position pattern values included in the position information about the tracker and the blasting pattern information stored in the blasting device are compared (S550).

Then, as a result of comparison, a detonator corresponding to a blasting hole located at a minimum distance from the position of the tracker is registered (S560).

The functional operations and the embodiments related to the present subject matter, which are described herein, may be implemented in a digital electronic circuit or computer software, firmware or hardware, or a combination of one or more of these, including the structures disclosed herein and structural equivalents thereof.

Embodiments of the subject matter described herein may be implemented as one or more modules relating to one or more computer program products, that is, computer program instructions encoded on a tangible program medium for execution by or to control the operation of a processing device. The tangible program medium may be a radio wave signal or a computer-readable medium. The radio wave signal is a signal generated to encode information for transmission to an appropriate receiver device for execution by a computer, for example, an artificially generated signal, such as a machine-generated electrical, optical or electromagnetic signal. The computer-readable medium may be a machine-readable storage device, a machine-readable storage substrate, a memory device, a combination of materials that affect a machine-readable radio wave signal, or a combination of one or more of these.

A computer program (also known as a program, software, software application, script or code) may be written in any form of any programming language, including compiled or interpreted language or a priori or procedural language, and it may be deployed in any form, including standalone programs or modules, components, subroutines, or other units suitable for use in a computer environment.

The computer program does not necessarily correspond to a file on a file device. A program may be stored in a single file dedicated to the requested program, in multiple coordinate files (e.g., files that stores one or more modules, subprograms, or portions of code), or in a portion of a file that holds other programs or data (e.g., one or more scripts stored within a markup language document).

The computer program may be deployed to be executed on a single computer or multiple computers located at one site or distributed over multiple sites and interconnected by a communication network.

Additionally, the logic flows and structural block diagrams described herein describe corresponding acts and/or specific methods supported by corresponding functions and steps supported by the disclosed structural means, and may also be used to set corresponding software structures and algorithms and equivalents thereof.

The processes and logic flows described herein may be performed by one or more programmable processors executing one or more computer programs to perform functions by operating on received data and generating outputs.

Processors suitable for the execution of a computer program include, by way of example, both general and special purpose microprocessors, and any one or more processors of any kind of digital computer. Generally, a processor will receive instructions and data from a read only memory or a random access memory or both.

The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical discs, or optical discs. However, a computer need not have such devices.

The present description sets forth the best mode of the invention, and provides examples to illustrate the invention, and to enable any person skilled in the art to manufacture or use the invention. The specification described in this way does not limit the present disclosure to the present concrete terms.

Therefore, while the present disclosure has been described in detail with reference to the examples described above, those skilled in the art may make modifications, changes, and variations to the examples without departing from the scope of the present disclosure. To sum up, it should be also understood that it is not necessary to include all functional blocks illustrated in the drawings or to follow all sequences illustrated in the drawings as the sequences illustrated in order to achieve the effects intended by the present disclosure, and it should be also understood that all technical ideas within the equivalent scope belong to the technical scope of the present disclosure described in claims.

The invention claimed is:

1. A blasting device for simultaneously registering multiple detonators based on blasting pattern information, the blasting device comprising:

a blasting pattern information input unit that receives blasting pattern information about a blasting operation to be performed to store the received blasting pattern information;

a key value sharing unit that shares a key value with a tracker possessed by an operator when the tracker is activated;

a blasting area entry recognition unit that recognizes at least one communication module and tracker that are activated in a blasting area; and a detonator registration unit that registers multiple detonators by using a number of the at least one communication module and tracker recognized in the blasting area and pre-stored blasting pattern information, wherein the key value sharing unit shares a key value for determining a blasting device in which each tracker is to be registered, when the tracker is to be registered with multiple blasting devices, and wherein the detonator registration unit includes:

a third registration unit that, when two or more trackers and one communication module are recognized in the blasting area, pairs the communication module with a tracker located at a minimum distance from the communication module, the minimum distance being obtained by each tracker measuring a distance from the communication module using a received round trip time (RTT) and then registers the communication module in the blasting device registered through the key value that the tracker has, and registers a detonator corresponding to a blasting hole located at a minimum distance from a position of the tracker by comparing position pattern values included in position information about the tracker and the blasting pattern information stored in the blasting device; and a fourth registration unit that, when two or more trackers and two or more communication modules are recognized in the blasting area, pairs a communication module and a tracker that are located at a minimum distance between each other, the minimum distance being obtained by each communication module and each tracker measuring a distance between each other using received round trip times (RTTs) and then registers the communication module in the blasting device registered through the key value that the tracker has, and registers a detonator corresponding to a blasting hole located at a minimum distance from a position of the tracker by comparing position pattern values included in position information about the tracker and the blasting pattern information stored in the blasting device.

2. The blasting device of claim 1, wherein the detonator registration unit includes:

a first registration unit that, when one tracker and one communication module are recognized in the blasting area, registers the communication module in the blasting device registered through the key value that the tracker has, and registers a detonator corresponding to a blasting hole located at a minimum distance from a position of the tracker by comparing position pattern values included in position information about the tracker and the blasting pattern information stored in the blasting device; and a second registration unit that, when one tracker and two or more communication modules are recognized in the blasting area, registers, in order, communication modules activated according to a deck charge number included in the blasting pattern information stored in the blasting device in the blasting device registered through the key value that the tracker has, and registers a detonator corresponding to a blasting hole located at a minimum distance from a position of the tracker by comparing position pattern values included in position information about the tracker and the blasting pattern information stored in the blasting device.

3. The blasting device of claim 1, further comprising a detonator position output unit that, when a registered detonator is activated, outputs a coordinate map according to a blasting blueprint for the registered detonator and a coordinate map according to global positioning system (GPS) information for a current detonator to a display.

4. The blasting device of claim 1, further comprising a detonator information check unit that outputs information about the registered detonator to a display by receiving the information about the registered detonator through the communication module when data loading is completed after the registered detonator is activated, to check and correct the information about the detonator through the display.

5. The blasting device of claim 1, further comprising an arming command transmission unit that transmits an arming command when data loading is completed after the registered detonator is activated and check of information about the detonator is completed.

6. The blasting device of claim 1, wherein the tracker receives a position correction value from a real time kinematic (RTK) positioning information system at preset time intervals, when the tracker is activated.

7. The blasting device of claim 1, wherein the communication module switches to a sleep mode after providing information about the registered detonator to the blasting device.

8. A method of using a blasting device, the method comprising:

receiving, by a blasting pattern information input unit, blasting pattern information about a blasting operation to be performed to store the received blasting pattern information;

sharing, by a key value sharing unit, a key value with a tracker possessed by an operator when the tracker is activated;

recognizing, by a blasting area entry recognition unit, at least one communication module and tracker that are activated in a blasting area; and registering, by a detonator registration unit, multiple detonators by using a number of the at least one communication module and tracker recognized in the blasting area and pre-stored blasting pattern information, further comprising:

at the sharing a key value with a tracker possessed by an operator when the tracker is activated, sharing a key value for determining a blasting device in which each tracker is to be registered, when the tracker is to be registered with multiple blasting devices, wherein the registering of the multiple detonators by using the number of the at least one communication module and tracker recognized in the blasting area and the pre-stored blasting pattern information includes:

when two or more trackers and one communication module are recognized in the blasting area, paring the communication module with a tracker located at a minimum distance from the communication module, the minimum distance being obtained by each tracker measuring a distance from the communication module using a received round trip time (RTT) and then registering the communication module in the blasting device registered through the key value that the tracker has, and registering a detonator corresponding to a blasting hole located at a minimum distance from a position of the tracker by comparing position pattern values included in position information about the tracker and the blasting pattern information stored in the blasting device; and when two or more trackers and two or more communication modules are recognized in the blasting area, paring a communication module and a tracker that are located at a minimum distance between each other, the minimum distance being obtained by each communication module and each tracker measuring a distance between each other using received round trip times (RTTs) and then registering the communication module in the blasting device registered through the key value that the tracker has, and registering a detonator corresponding to a blasting hole located at a minimum distance from a position of the tracker by comparing position pattern values included in position information about the tracker and the blasting pattern information stored in the blasting device.

9. The method of claim 8, wherein the registering of the multiple detonators by using the number of the at least one communication module and tracker recognized in the blasting area and pre-stored blasting pattern information includes:

when one tracker and one communication module are recognized in the blasting area, registering the communication module in the blasting device registered through the key value that the tracker has, and registering a detonator corresponding to a blasting hole located at a minimum distance from a position of the tracker by comparing position pattern values included in position information about the tracker and the blasting pattern information stored in the blasting device.

10. The method of claim 8, wherein the registering of the multiple detonators by using the number of the at least one communication module and tracker recognized in the blasting area and the pre-stored blasting pattern information includes:

when one tracker and two or more communication modules are recognized in the blasting area, registering, in order, communication modules activated according to a deck charge number included in the blasting pattern information stored in the blasting device in the blasting device registered through the key value that the tracker has, and registering a detonator corresponding to a blasting hole located at a minimum distance from a position of the tracker by comparing position pattern values included in position information about the tracker and the blasting pattern information stored in the blasting device.

11. The method of claim 8, further comprising:

after the registering of the multiple detonators by using the number of the at least one communication module and tracker recognized in the blasting area and the pre-stored blasting pattern information, outputting, when a registered detonator is activated, a coordinate map according to a blasting blueprint for a registered detonator and a coordinate map according to global positioning system (GPS) information for a current detonator to a display.

12. The method of claim 8, further comprising:

after the registering of the multiple detonators by using the number of the at least one communication module and tracker recognized in the blasting area and the pre-stored blasting pattern information, outputting information about the registered detonator to a display by receiving the information about the registered detonator through the communication module when data loading is completed after the registered detonator is activated, to check and correct the information about the detonator through the display.

13. The method of claim 8, further comprising:

after the registering of the multiple detonators by using the number of the at least one communication module and tracker recognized in the blasting area and the pre-stored blasting pattern information, transmitting an arming command when data loading is completed after the registered detonator is activated and check of information about the detonator is completed.

* * * * *